United States Patent [19]

Sakashita et al.

[11] Patent Number: 5,014,089

[45] Date of Patent: May 7, 1991

[54] DEVELOPER IN AN IMAGE FORMING DEVICE HAVING A BINDING RESIN AND MAGNETIC POWDER

[75] Inventors: Kiichiro Sakashita, Inagi; Toshiaki Nakahara, Tokyo; Hirohide Tanikawa, Yokohama; Naoki Matsushige; Satoshi Yoshida, both of Kawasaki; Masatsugu Fujiwara; Yasuo Mitsuhashi, both of Yokohama, all of Japan

[73] Assignee: Canon Kabushiki Kaisha, Tokyo, Japan

[21] Appl. No.: 528,472

[22] Filed: May 25, 1990

Related U.S. Application Data

[62] Division of Ser. No. 261,987, Oct. 25, 1988, Pat. No. 4,957,840.

[30] Foreign Application Priority Data

Oct. 26, 1987 [JP] Japan ..... 62-271119

[51] Int. Cl.[5] ..... G03G 15/09

[52] U.S. Cl. ..... 355/251; 118/653; 118/657; 355/253

[58] Field of Search ..... 355/259, 251, 253, 249, 355/246; 430/106.6, 109, 107, 111, 137, 122, 903; 118/653, 657, 668

[56] References Cited

U.S. PATENT DOCUMENTS

| | | | |
|---|---|---|---|
| 4,284,701 | 8/1981 | Abbott et al. | 430/111 |
| 4,297,970 | 11/1981 | Tajima et al. | 118/658 X |
| 4,592,987 | 6/1986 | Mitsuhashi et al. | 118/658 X |
| 4,737,433 | 4/1988 | Rimai et al. | 430/111 |

*Primary Examiner*—A. T. Grimley
*Assistant Examiner*—Thu Anh Dang
*Attorney, Agent, or Firm*—Fitzpatrick, Cella, Harper & Scinto

[57] ABSTRACT

A developer for developing electrostatic images, containing a magnetic toner having a binder resin and magnetic powder, the developer containing 17–60% by number of magnetic toner particles of 5 microns or smaller, containing 1–23% by number of magnetic toner particles of 8–12.7 microns, and containing 2.0% by volume or less of magnetic toner particles of 16 microns or larger; wherein the magnetic toner has a volume-average particle size of 4–9 microns, and the magnetic toner particles of 5 microns or smaller have a particle size distribution satisfying the following:

$$N/V = -0.04N + k,$$

wherein N denotes % by number of magnetic toner particles of 5 micron or smaller, V denotes % by volume of magnetic toner particles of 5 microns or smaller, k denotes a positive number of 4.5–6.5, and N denotes a positive number of 17–60.

3 Claims, 6 Drawing Sheets

DEVELOPER IN AN IMAGE FORMING DEVICE HAVING A BINDING RESIN AND MAGNETIC POWDER

This application is a division of allowed application Ser. No. 261,987 filed Oct. 25, 1988 now U.S. Pat. No. 4,957,840.

FIELD OF THE INVENTION AND RELATED ART

The present invention relates to a developer a magnetic toner for use in image forming methods, such as electrophotography and electrostatic recording, and an image forming device using the developer.

Recently, as image forming apparatus such as electrophotographic copying machines have widely been used, their uses have also extended in various ways, and higher image quality has been demanded. For example, when original images such as general documents and books are copied, it is demanded that even minute letters be reproduced extremely finely and faithfully without thickening or deformation, or interruption. However, for ordinary image forming apparatus such as copying machines for plain paper, when the latent image formed on a photosensitive member thereof comprises thin-line images having a width of 100 microns or less, the reproducibility in thin lines is generally poor and the clarity of line images is still insufficient.

Particularly, in recent image forming apparatus such as electrophotographic printers using digital image signals, the resultant latent picture is formed by a gathering of dots with a constant potential, and the solid, half-tone and highlight portions of the picture can be expressed by varying densities of dots. However, when the dots are not faithfully covered with toner particles and the toner particles protrude from the dots, there arises the problem that a gradational characteristic of a toner image corresponding to the dot density ratio of the black portion to the white portion in the digital latent image cannot be obtained. Further, when the resolution is intended to be enhanced by decreasing the dot size so as to enhance the image quality, reproducibility becomes poorer with respect to the latent image comprising minute dots, whereby there tends to occur an image without sharpness having a low resolution and a poor gradational characteristic.

On the other hand, in image forming apparatus such as electrophotographic copying machines, there sometimes occurs a phenomenon such that good image quality is obtained in an initial stage but deteriorates as the copying or print-out operation is successively conducted. The reason for such phenomenon may be that toner particles which more contribute to the developing operation are consumed in advance as the copying or print-out operation is successively conducted, and toner particles having a poor developing characteristic accumulate and remain in the developing device of the image forming apparatus.

Hitherto, there have been proposed some developers for the purpose of enhancing the image quality. For example, Japanese Laid-Open Patent Application (JP-A, KOKAI) No. 3244/1976 (corresponding to U.S. Pat. Nos. 3942979, 3969251 and 4112024) has proposed a non-magnetic toner wherein the particle size distribution is regulated so as to improve the image quality. This toner comprises relatively coarse particles and comprises about 25% by number or more of toner particles having a particle size of 8–12 microns. However, according to our investigation, it is difficult for such a particle size to provide uniform image. Further, the above-mentioned toner has a characteristic such that it contains 30 % by number or less (e.g., about 29 % by number) of particles of 5 microns or smaller and 5 % by number or less (e.g., about 5 % by number) of particles of 20 microns or larger, and therefore it has a broad particle size distribution which tends to decrease the uniformity in the resultant image. In order to form a clear image by using such relatively coarse toner particles having a broad particle size distribution, it is necessary that the gaps between the toner particles are filled by thickly superposing the toner particles thereby to enhance the apparent image density. As a result, there arises a problem that the toner consumption increases in order to obtain a prescribed image density.

Japanese Laid-Open Patent Application No. 72054/1979 (corresponding to U.S. Pat. No. 4284701) has proposed a non-magnetic toner having a sharper particle size distribution than the above-mentioned toner. In this toner, particles having an intermediate weight have a relatively large particle size of 8.5–11.0 microns, and there is still room for improvement as a toner for a high resolution.

Japanese Laid-Open Patent Application No. 129437/1983 (corresponding to British Patent No. 2114310) has proposed a non-magnetic toner wherein the average particle size is 6–10 microns and the mean particle size is 5–8 microns. However, this toner only contains particles of 5 microns or less in a small amount of 15% by number or below, and it tends to form an image without sharpness.

Further, U.S. Pat. No. 4299900 has proposed a jumping developing method using a developer containing 10–50 wt. % of magnetic toner particles of 20–35 microns. In this method, the particle size distribution of the toner is improved in order to triboelectrically charge the magnetic toner, to form a uniform and thin toner layer on a sleeve (developer-carrying member), and to enhance the environmental resistance of the toner. However, in view of a further high demand for the thin-line reproducibility and resolution, the above-mentioned particle size distribution is still insufficient, and there is room for further improvement.

SUMMARY OF THE INVENTION

An object of the present invention is to provide a developer comprising a magnetic toner which has solved the above-mentioned problems, and an image forming device having the developer.

Another object of the present invention is to provide a developer comprising a magnetic toner which has an excellent thin-line reproducibility and gradational characteristic and is capable of providing a high image density, and an image forming device having the developer.

A further object of the present invention is to provide a developer comprising a magnetic toner which shows little change in performances when used in a long period, and an image forming device having the developer.

A further object of the present invention is to provide a developer comprising a magnetic toner which shows little change in performance even when environmental conditions change, and an image forming device having the developer.

A further object of the present invention is to provide a developer comprising a magnetic toner which shows an excellent transferability, and an image forming device having the developer.

A further object of the present invention is to provide a developer comprising a magnetic toner which is capable of providing a high image density by using a small consumption thereof, and an image forming device having the developer.

A still further object of the present invention is to provide a developer comprising a toner which is capable of forming a toner image excellent in resolution, gradational characteristic, and thin-line reproducibility even when used in an image forming apparatus using a digital image signal, and an image forming device having the developer.

According to our investigation, it has been found that toner particles having a particle size of 5 microns or smaller have a primary function of clearly reproducing the contour of a latent image and of attaining close and precise cover-up of the toner to the entire latent image portion.

Particularly, in the case of an electrostatic latent image formed on a photosensitive member, the field intensity in the edge portion thereof as the contour is higher than that in the inner portion thereof because of the concentration of the electric lines of force, whereby the sharpness of the resultant image is determined by the quality of toner particles collected to this portion. According to our investigation, it has been found that the control of quantity and distribution state for toner particles of 5 microns or smaller is effective in solving the problem in image sharpness.

According to our investigation, it has further been found problematic that relatively long ears or chains composed of magnetic toner particles and disturbed ears are present on the surface of a sleeve in a developing region. We have studied such problem in consideration of the above-mentioned knowledge, and reached the present invention.

According to the present invention, there is provided a developer for developing electrostatic images, comprising a magnetic toner comprising a binder resin and magnetic powder, the developer containing 17–60 % by number of magnetic toner particles having a particle size of 5 microns or smaller, containing 1–23 % by number of magnetic toner particles having a particle size of 8–12.7 microns, and containing 2.0 % by volume or less of magnetic toner particles having a particle size of 16 microns or larger;

wherein the magnetic toner has a volume average particle size of 4–9 microns, and the magnetic toner particles having a particle size of 5 microns or smaller has a particle size distribution satisfying the following formula:

$$N/V = -0.04N + k,$$

wherein N denotes the percentage by number of magnetic toner particles having a particle size of 5 micron or smaller, V denotes the percentage by volume of magnetic toner particles having a particle size of 5 microns or smaller, k denotes a positive number of 4.5–6.5, and N denotes a positive number of 17–60. image forming device for developing electrostatic The present invention further provides an image forming device for developing electrostatic images held on an electrostatic image- holding member, comprising:

a developer chamber containing a developer for developing the electrostatic images, comprising a magnetic toner comprising a binder resin and magnetic powder, the developer containing 17–60 % by number of magnetic toner particles having a particle size of 5 microns or smaller, containing 1–23 % by number of magnetic toner particles having a particle size of 8–12.7 microns, and containing 2.0 % by volume or less of magnetic toner particles having a particle size of 16 microns or larger; wherein the magnetic toner has a volume-average particle size of 4–9 microns, and the magnetic toner particles having a particle size of 5 microns or smaller has a particle size distribution satisfying the following formula:

$$N/V = -0.04N + k,$$

wherein N denotes the percentage by number of magnetic toner particles having a particle size of 5 micron or smaller, V denotes the percentage by volume of magnetic toner particles having a particle size of 5 microns or smaller, k denotes a positive number of 4.5–6.5, and N denotes a positive number of 17–60;

toner-carrying means having a surface to hold a toner layer thereon and to carry the toner layer to a developing zone; the toner layer being formed of the magnetic toner particles supplied from the developer chamber, the toner-carrying means being made of a non magnetic material;

magnetic means for generating a stationary magnetic field at the developing zone through the non magnetic toner-carrying means toward the surface of the electrostatic image-holding member;

means for forming the layer of the magnetic toner particles of substantially uniform thickness on the surface of the toner-carrying means; and means for maintaining a space between the toner-carrying means and the electrostatic image holding member at the developing zone within a predetermined range to form a space gap between the electostatic image-holding member and the surface of the layer of the magnetic toner particles on the toner-carrying means.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
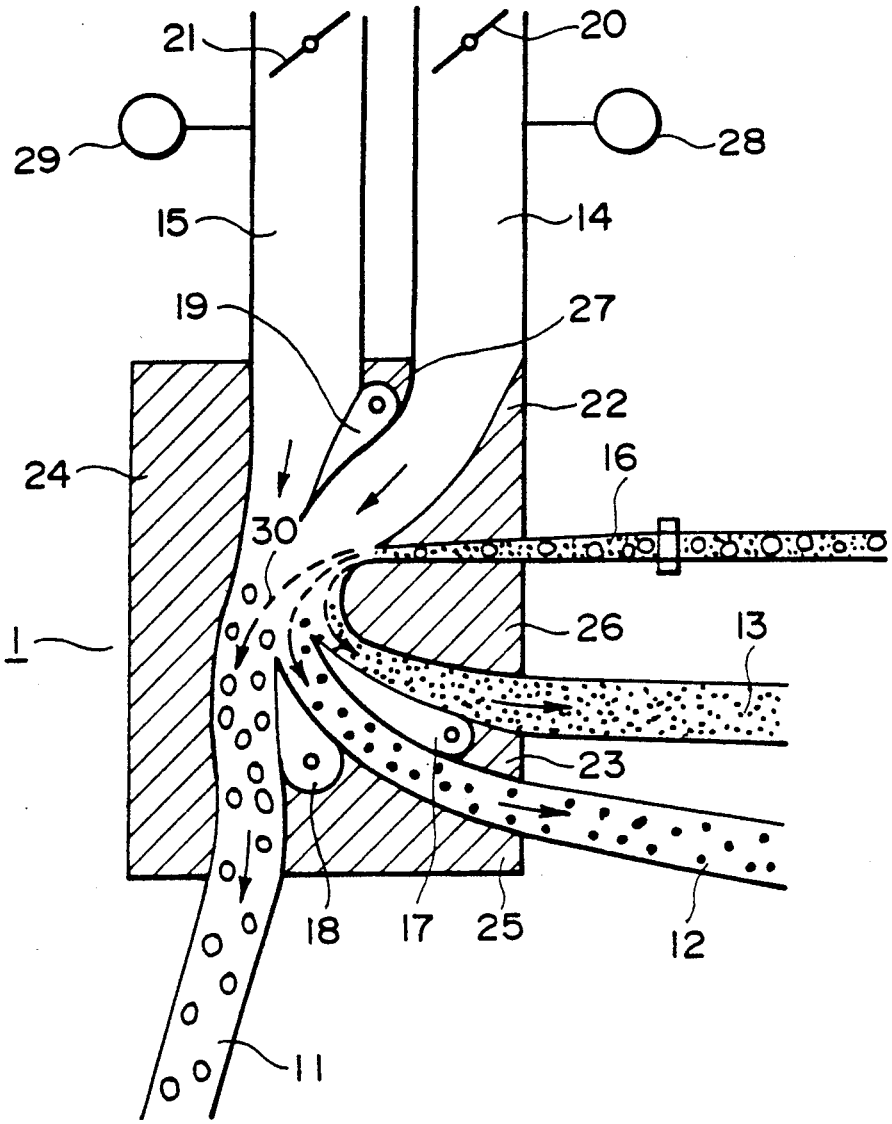
FIGS. 1 and 2 are a front sectional view and a sectional perspective view, respectively, of an apparatus embodiment for practicing multi-division classification.

The magnetic toner according to the present invention and having the above-mentioned particle size distribution can faithfully reproduce thin lines in a latent image formed on a photosensitive member, and is excellent in reproduction of dot latent images such as halftone dot and digital images, whereby it provides images excellent in gradation and resolution characteristics. Further, the toner according to the present invention can retain a high image quality even in the case of successive copying or print-out, and can effect good development by using a smaller consumption thereof as compared with the conventional magnetic toner, even in the case of high-density images. As a result, the magnetic toner of the present invention is excellent in economical characteristics and further has an advantage in miniaturization of the main body of a copying machine or printer. Particularly, the developer of the present invention is useful as a one component type developer without using carrier particles.

The reason for the above-mentioned effects of the magnetic toner of the present invention is not necessarily clear but may assumably be considered as follows.

The magnetic toner of the present invention is first characterized in that it contains 17–60 % by number of magnetic toner particles of 5 microns or below. Conventionally, it has been considered that magnetic toner particles of 5 microns or below are required to be positively reduced because the control of their charge amount is difficult, they impair the fluidity of the magnetic toner, and they cause toner scattering to contaminate the machine.

However, according to our investigation, it has been found that the magnetic toner particles of 5 microns or below are an essential component to form a high-quality image.

For example, we have conducted the following experiment.

Thus, there was formed on a photosensitive member a latent image wherein the surface potential on the photosensitive member was changed from a large developing potential contrast at which the latent image would easily be developed with a large number of toner particles, to a small developing potential contrast at which the latent image would be developed with only a small number of toner particles.

Such latent image was developed with a magnetic toner having a particle size distribution ranging from 0.5 to 30 microns. Then, the toner particles attached to the photosensitive member were collected and the particle size distribution thereof was measured. As a result, it was found that there were many magnetic toner particles having a particle size of 8 microns or below, particularly 5 microns or below. Based on such finding, it was discovered that when magnetic toner particles of 5 microns or below were so controlled that they were smoothly supplied for the development of a latent image formed on a photosensitive member, there could be obtained an image truly excellent in reproducibility, and the toner particles were faithfully attached to the latent image without protruding therefrom.

The magnetic toner of the present invention is secondly characterized in that it contains 1–23 % by number of magnetic toner particles of 8–12.7 microns. Such second feature relates to the above-mentioned necessity for the presence of the toner particles of 5 microns or below.

As described above, the toner particles having a particle size of 5 microns or below have the ability to strictly cover a latent image and to faithfully reproduce it. On the other hand, in the latent image per se, the field intensity in its peripheral edge portion is higher than that in its central portion. Therefore, toner particles sometimes cover the inner portion of the latent image in a smaller amount than that in the edge portion thereof, whereby the image density in the inner portion appears to be lower. Particularly, the magnetic toner particles of 5 microns or below strongly have such tendency. However, we have found that when 1–23 % by number (preferably 8–20 % by number) of toner particles of 8–12.7 microns are contained in a toner, not only the above-mentioned problem can be solved but also the resultant image can be made clearer.

According to our knowledge, the reason for such phenomenon may be considered that the toner particles of 8–12.7 microns have suitably controlled charge amount in relation to those of 5 microns or below, and that these toner particles are supplied to the inner portion of the latent image having a lower field intensity than that of the edge portion thereby to compensate the decrease in cover-up of the toner particles to the inner portion as compared with that in the edge portion, and to form a uniform developed image. As a result, there may be provided a sharp image having a high-image density and excellent resolution and gradation characteristic.

The third feature of the magnetic toner of the present invention is that toner particles having a particle size of 5 microns or smaller contained therein satisfy the following relation between their percentage by number (N) and percentage by volume (V):

$$N/V = -0.04\,N + k,$$

wherein $4.5 \leqq k \leqq 6.5$, and $17 \leqq N \leqq 60$.

Figure 4:
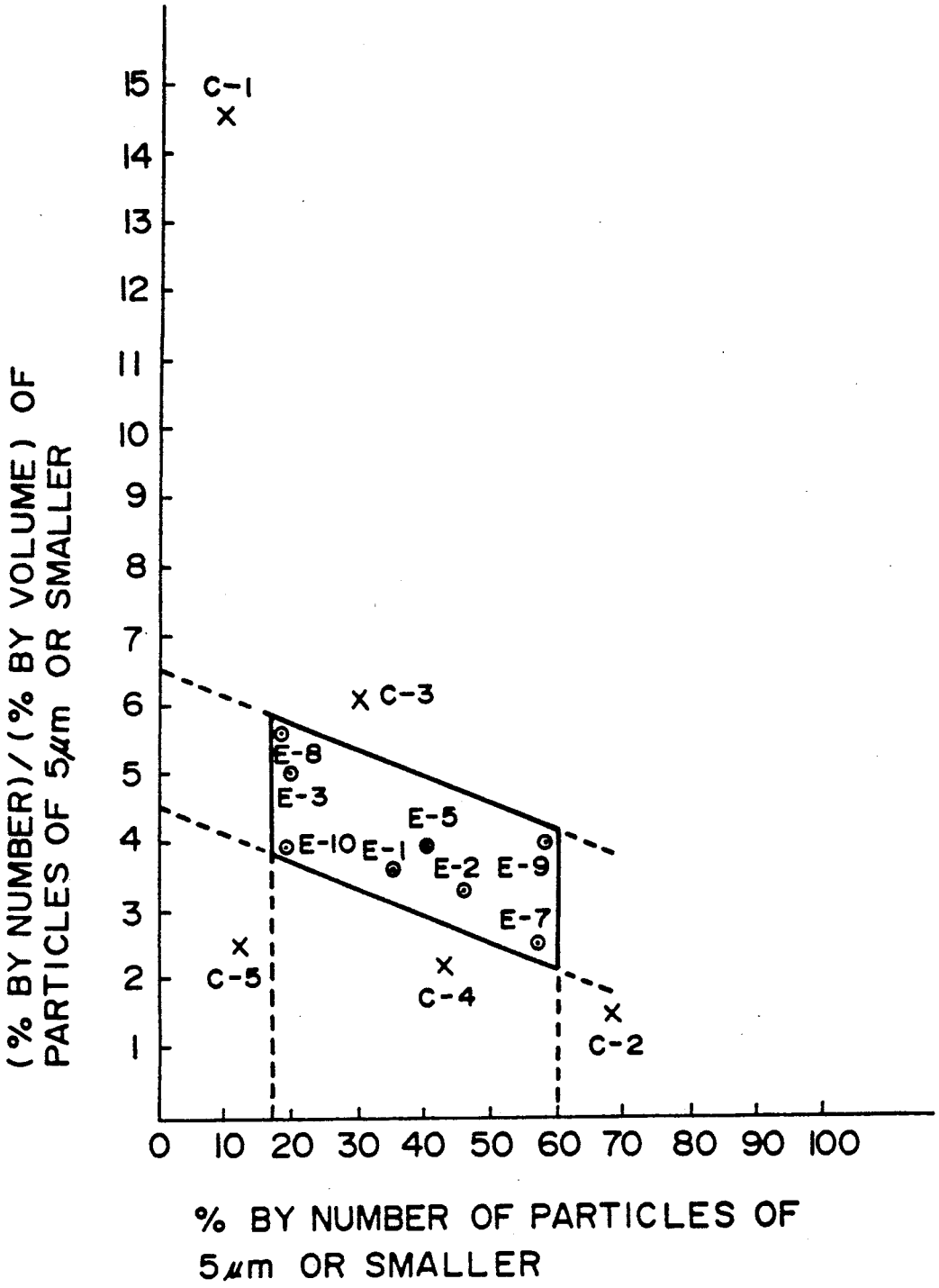
FIG. 4 is a graph obtained by plotting values of % by number (N)/% by volume (V) against % by number with respect to magnetic toner particles having a particle size of 5 microns or below.

The region satisfying such relationship is shown in FIG. 4. The magnetic toner according to the present invention which has the particle size distribution satisfying such region, in addition to the above-mentioned features, can attain excellent developing characteristic.

According to our investigation on the state of the particle size distribution with respect to toner particles of 5 microns or below, we have found that there is a suitable state of the presence of fine powder in magnetic toner particles. More specifically, in the case of a certain value of N, it may be understood that a large value of N/V indicates that the particles of 5 microns or below (e.g., 2–4 microns) are significantly contained, and a small value of N/V indicates that the frequency of the presence of particles near 5 microns (e.g., 4–5 microns) is high and that of particles having a smaller particle size is low. When the value of N/V is in the range of 2.1–5.82, N is in the range of 17–60, and the relation represented by the above-mentioned formula is satisfied, good thin-line reproducibility and high resolution are attained.

In the magnetic toner of present invention, magnetic toner particles having a particle size of 16 microns or larger are contained in an amount of 2.0 % by volume or below. The amount of these particles may preferably be as small as possible.

As described hereinabove, the magnetic toner of the present invention has solved the problems encountered in the prior art from a viewpoint utterly different from that in the prior art, and can meet the recent severe demand for high image quality.

Hereinbelow, the present invention will be described in more detail.

In the present invention, the magnetic toner particles having a particle size of 5 microns or smaller are contained in an amount of 17–60 % by number, preferably 25–50 % by number, more preferably 30–50 % by number, based on the total number of particles. If the amount of magnetic toner particles is smaller than 17 % by number, the toner particles effective in enhancing image quality is insufficient. Particularly, as the toner particles are consumed in successive copying or print-out, the component of effective magnetic toner particles is decreased, and the balance in the particle size distribution of the magnetic toner shown by the present invention is deteriorated, whereby the image quality gradually decreases. On the other hand, the above-mentioned amount exceeds 60 % by number, if the magnetic toner particles are liable to be mutually agglomerated to produce toner agglomerates having a size larger than the original particle size. As a result, roughened images are provided, the resolution is lowered, and the density difference between the edge and inner portions is increased, whereby an image having an inner portion with a little low density is liable to occur.

In the magnetic toner of the present invention, the amount of particles in the range of 8–12.7 microns is 1–23 % by number, preferably 8–20 % by number. If the above-mentioned amount is larger than 23 % by number, not only the image quality deteriorates but also excess development (i.e., excess cover-up of toner particles) occurs, thereby to invite an increase in toner consumption. On the other hand, if the above-mentioned amount is smaller than 1 %, it is difficult to obtain a high image density.

In the present invention, the percentage by number (N %) and that by volume (V %) of magnetic toner particles having a particle size of 5 microns or less satisfy the relationship of $N/V=-0.04\ N+k$, wherein k represents a positive number satisfying $4.5 \leqq k \leqq 6.5$. The number k may preferably satisfy $4.5 \leqq k \leqq 6.0$, more preferably $4.5 \leqq k \leqq 5.5$ Further, as described above, the percentage N satisfies $17 \leqq N \leqq 60$, preferably $25 \leqq N \leqq 50$, more preferably $30 \leqq N \leqq 50$.

If $k<4.5$, magnetic toner particles of 5.0 microns or below are insufficient, and the resultant image density, resolution and sharpness decrease. When fine toner particles in a magnetic toner, which have conventionally been considered useless, are present in an appropriate amount, they attain closest packing of toner in development (i.e., in a latent image formed on a photosensitive drum) and contribute to the formation of a uniform image free of coarsening. Particularly, these particles fill thin-line portions and contour portions of an image, thereby to visually improve the sharpness thereof. If $k<4.5$ in the above formula, such component becomes insufficient in the particle size distribution, the above-mentioned characteristics become poor.

Further, in view of the production process, a large amount of fine powder must be removed by classification in order to satisfy the condition of $k<4.5$. Such process is disadvantageous in yield and toner costs.

On the other hand, if $k>6.5$, an excess of fine powder is present, whereby the resultant image density is liable to decrease in successive copying. The reason for such phenomenon may be considered that an excess of fine magnetic toner particles having an excess amount of charge are triboelectrically attached to a developing sleeve and prevent normal toner particles from being carried on the developing sleeve and being supplied with charge.

In the magnetic toner of the present invention, the amount of magnetic toner particles having a particle size of 16 microns or larger is 2.0% by volume or smaller, preferably 1.0 % by volume or smaller, more preferably 0.5 % by volume or smaller.

If the above amount is larger than 2.0 % by volume, these particles impair thin-line reproducibility. In addition, toner particles of 16 microns or larger are present as protrusions on the surface of the thin layer of toner particles formed on a photosensitive member by development, and they vary the transfer condition for the toner by irregulating the delicate contact state between the photosensitive member and a transfer paper (or a transfer-receiving paper) by the medium of the toner layer. As a result, there occurs an image with transfer failure.

In the present invention, the number-average particle size of the toner is 4–9 microns, preferably 4–8 microns. This value closely relates to the above-mentioned features of the magnetic toner according to the present invention. If the number-average particle size is smaller than 4 microns, there tend to occur problems such that the amount of toner particles transferred to a transfer paper is insufficient and the image density is low, in the case of an image such as graphic image wherein the ratio of the image portion area to the whole area is high. The reason for such phenomenon may be considered the same as in the above-mentioned case wherein the inner portion of a latent image provides a lower image density than that in the edge portion thereof. If the number-average particle size exceeds 9 microns, the resultant resolution is not good and there tends to occur a phenomenon such that the image quality is lowered in successive use even when it is good in the initial stage thereof.

The particle distribution of a toner is measured by means of a Coulter counter in the present invention, while it may be measured in various manners.

Coulter counter Model TA--II (available from Coulter Electronics Inc.) is used as an instrument for measurement, to which an interface (available from Nikkaki K.K.) for providing a number-basis distribution, and a volume-basis distribution and a personal computer CX-1 (available from Canon K.K.) are connected.

For measurement, a 1 %-NaCl aqueous solution as an electrolytic solution is prepared by using a reagent-grade sodium chloride. Into 100 to 150 ml of the electrolytic solution, 0.1 to 5 ml of a surfactant, preferably an alkylbenzenesulfonic acid salt, is added as a dispersant, and 2 to 20 mg, of a sample is added thereto. The resultant dispersion of the sample in the electrolytic liquid is subjected to a dispersion treatment for about 1–3 minutes by means of an ultrasonic disperser, and then subjected to measurement of particle size distribution in the range of 2–40 microns by using the above-mentioned Coulter counter Model TA-II with a 100 micron-aperture to obtain a volume-basis distribution and a number-basis distribution. Form the results of the volume-basis distribution and number-basis distribution, parameters characterizing the magnetic toner of the present invention may be obtained.

In the present invention, the true density of the magnetic toner may preferably be 1.45–1.70 g/cm$^3$, more preferably 1.50–1.65 g/cm$^3$. When the true density is in such range, the magnetic toner according to the present invention having a specific particle size distribution functions most effectively in view of high image quality and stability in successive use.

If the true density of the magnetic toner particles is smaller than 1.45, the weight of the particle per se is too light and there tends to occur reversal fog, deformation of thin lines, and scattering and deterioration in resolution because an excess of toner particles are attached to the latent image. On the other hand, the true density of the magnetic toner is larger than 1.70, there occurs an image wherein the image density is low, thin lines are interrupted, and the sharpness is lacking. Further, because the magnetic force becomes relatively strong in such case, ears of the toner particles are liable to be lengthened or converted into a branched form. As a result, the image quality is disturbed in the development of a latent image, whereby a coarse image is liable to occur.

In the present invention, the true density of the magnetic toner is measured in the following manner which can simply provide an accurate value in the measurement of fine powder, while the true density can be measured in some manners.

There are provided a cylinder of stainless steel having an inside diameter of 10mm and a length of about 5cm, a disk (A) having an outside diameter of about 10mm and a height of about 5mm, and a piston (B) having an outside diameter about 10 mm and a length of about 8cm, which are capable of being closely inserted into the cylinder.

In the measurement, the disk (A) is first disposed on the bottom of the cylinder and about 1 g of a sample to be measured is charged in the cylinder, and the piston (B) is gently pushed into the cylinder. Then, a force of 400 $Kg/cm^2$ is applied to the piston by means of a hydraulic press, and the sample is pressed for 5 min. The weight (Wg) of the thus pressed sample is measured and the diameter (D cm) and the height (L cm) thereof are measured by means of a micrometer. Based on such measurement, the true density may be calculated according to the following formula:

$$\text{True density } (g/cm^3) = W/(\pi \times (D/2)^2 \times L)$$

In order to obtain better developing characteristics, the magnetic toner of the present invention may preferably have the following magnetic characteristics: a residual magnetization $\sigma_r$ of 1–5 emu/g, more preferably 214 4.5 emu/g; a saturation magnetization $\sigma_s$ of 20–40 emu/g; and a coercive force Hc of 40–100 Öe. These magnetic characteristics may be measured under a magnetic field for measurement of 1000 Öe.

The binder for use in constituting the toner according to the present invention, when applied to a hot pressure roller fixing apparatus using an oil applicator, may be a known binder resin for toners. Examples thereof may include: homopolymers of styrene and its derivatives, such as polystyrene, poly-p-chlorostyrene, and polyvinyltoluene; styrene copolymers, such as styrene-p-chlorostyrene copolymer, styrene-vinyltoluene copolymer, styrenevinylnaphthalene copolymer, styrene-acrylate copolymer, styrene-methacrylate copolymer, styrene-methyl α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, and styrene-acrylonitrile indene copolymer; polyvinyl chloride, phenolic resin, natural resin-modified phenolic resin, natural resin modified maleic acid resin, acrylic resin, methacrylic resin, polyvinyl acetate, silicone resin, polyester resin, polyurethane, polyamide resin, furan resin, epoxy resin, xylene resin, polyvinylbutyral, terpene resin, coumarone-indene resin and petroleum resin.

In a hot pressure roller fixing system using substantially no oil application, serious problems are provided by an offset phenomenon that a part of toner image on toner image-supporting member is transferred to a roller, and an intimate adhesion of a toner on the toner image-supporting member. As a toner fixable with a less heat energy is generally liable to cause blocking or caking in storage or in a developing apparatus, this should be also taken into consideration. With these phenomenon, the physical property of a binder resin in a toner is most concerned. According to our study, when the content of a magnetic material in a toner is decreased, the adhesion of the toner onto the toner image-supporting member mentioned above is improved, while the offset is more readily caused and also the blocking or caking are also more liable to occur. Accordingly, when a hot roller fixing system using almost no oil application is adopted in the present invention, selection of a binder resin becomes more serious. A preferred binder resin may for example be a crosslinked styrene copolymer, or a crosslinked polyester. Examples of comonomers to form such a styrene copolymer may include one or more vinyl monomers selected from: monocarboxylic acid having a double bond and their substituted derivatives, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and their substituted derivatives, such as maleic acid, butyl maleate, methyl maleate, and dimethyl maleate; vinyl esters, such as vinyl chloride, vinyl acetate, and vinyl benzoate; ethylenic olefins, such as ethylene, propylene, and butylene; vinyl ketones, such as vinyl methyl ketone, and vinyl hexyl ketone; vinyl ethers, such as vinyl methyl ether, vinyl ethyl ether, and vinyl isobutyl ethers. As the crosslinking agent, a compound having two or more polymerizable double bonds may principally be used. Examples thereof include: aromatic divinyl compounds, such as divinylbenzene, and divinylnaphthalene; carboxylic acid esters having two double bonds, such as ethylene glycol diacrylate, ethylene glycol dimethacrylate, and 1, 3-butanediol diacrylate; divinyl compounds such as divinyl ether, divinyl sulfide and divinyl sulfone; and compounds having three or more vinyl groups. These compounds may be used singly or in mixture. In view of the fixability and anti-offset characteristic of the toner, the crosslinking agent may preferably be used in an amount of 0.01–10 wt. %, preferably 0.05–5 wt. %, based on the weight of the binder resin.

For a pressure-fixing system, a known binder resin for pressure-fixable toner may be used. Examples thereof may include: polyethylene, polypropylene, polymethylene, polyurethane elastomer, ethylene-ethyl acrylate copolymer, ethylene-vinyl acetate copolymer, ionomer resin, styrene-butadiene copolymer, styrene isoprene copolymer, linear saturated polyesters and paraffins.

In the magnetic toner of the present invention, it is preferred that a charge controller may be incorporated in the toner particles (internal addition), or may be mixed with the toner particles (external addition). By using the charge controller, it is possible to most suitably control the charge amount corresponding to a developing system to be used. Particularly, in the present invention, it is possible to further stabilize the balance between the particle size distribution and the charge. As a result, when the charge controller is used in the present invention, it is possible to further clarify the above-mentioned functional separation and mutual compensation corresponding to the particle size ranges, in order to enhance the image quality.

Examples of the charge controller may include: nigrosine and its modification products modified by a fatty acid metal salt; quaternary ammonium salts, such as tributylbenzyl-ammonium-1 hydroxy-4-naphthosulfonic acid salt, and tetrabutylammonium tetrafluoroborate; diorganotin oxides, such as dibutyltin oxide, dioctyltin oxide, and dicyclohexyltin oxide; and diorganotin borates, such as dibutyltin borate, dioctyltin borate, and dicyclo-hexyltin borate. These positive charge controllers may be used singly or as a mixture of two or more species. Among these, a nigrosine-type charge controller or a quaternary ammonium salt charge controller may particularly preferably be used.

As another type of positive charge controller, there may be used a homopolymer of a monomer having an amino group represents by the formula:

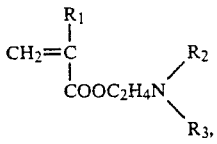

wherein $R_1$ represents H or $CH_3$; and $R_2$ and $R_3$ each represent a substituted or unsubstituted alkyl group (preferably $C_1$–$C_4$); or a copolymer of the monomer having an amine group with another polymerizable monomer such as styrene, acrylates, and methacrylates as described above. In this case, the positive charge controller also has a function of a binder.

On the other hand, a negative charge controller can be used in the present invention. Examples thereof may include an organic metal complex or a chelate compound. More specifically there may preferably be used aluminum acetyl -acetonate, iron (II) acetylacetonate, and a 3,5-di-tertiary butylsalicylic acid chromium. There may more preferably be used acetylacetone complexes, or salicylic acid-type metal salts or complexes. Among these, salicylic acid-type complexes or metal salts may particularly preferably be used.

It is preferred that the above-mentioned charge controller is used in the form of fine powder. In such case, the number-average particle size thereof may preferably be 4 microns or smaller, more preferably 3 microns or smaller.

In the case of internal addition, such charge controller may preferably be used in an amount of 0.1–20 wt. parts, more preferably 0.2–10 wt. parts, per 100 wt. parts of a binder resin.

It is preferred that silica fine powder is added to the magnetic toner of the present invention.

In the magnetic toner of the present invention having the above-mentioned particle size distribution characteristic, the specific surface area thereof becomes larger than that in the conventioned toner. In a case where the magnetic toner particles are caused to contact the surface of a cylindrical electroconductive non-magnetic sleeve containing a magnetic field-generating means therein in order to triboelectrically charge them, the frequency of the contact between the toner particle surface and the sleeve is increased as compared to that in the conventional magnetic toner, whereby the abrasion of the toner particle or the contamination of the sleeve is liable to occur. However, when the magnetic toner of the present invention is combined with the silica fine powder, the silica fine powder is disposed between the toner particles and the sleeve surface, whereby the abrasion of the toner particle is remarkably reduced.

Thus, the life of the magnetic toner and the sleeve may be lengthened and the chargeability may stably be retained. As a result, there can be provided a developer comprising a magnetic toner showing excellent characteristics in long-time use. Further, the magnetic toner particles having a particle size of 5 microns or smaller, which play an important role in the present invention, may produce a better effect in the presence of the silica fine powder, thereby to stably provide high-quality images.

The silica fine powder may be those produced through the dry process and the wet process. The silica fine powder produced through the dry process is preferred in view of the anti-filming characteristic and durability thereof.

The dry process referred to herein is a process for producing silica fine powder through vapor phase oxidation of a silicon halide. For example, silica powder can be produced according to the method utilizing pyrolytic oxidation of gaseous silicon tetrachloride in oxygen-hydrogen flame, and the basic reaction scheme may be represented as follows:

$$SiCl_4+2H_2+O_2 \rightarrow SiO_2+4HCl.$$

In the above preparation step, it is also possible to obtain a complex fine powder of silica and other metal oxides by using other metal halide compounds such as aluminum chloride or titanium chloride together with silicon halide compounds. Such is also included in the fine silica powder to be used in the present invention.

Commercially available fine silica powder formed by vapor phase oxidation of a silicon halide to be used in the present invention include those sold under the trade names as shown below.

| | |
|---|---|
| AEROSIL | 130 |
| (Nippon Aerosil Co.) | 200 |
| | 300 |
| | 380 |
| | OX 50 |
| | TT 600 |
| | MOX 80 |
| | COK 84 |
| Cab-O-Sil | M-5 |
| (Cabot Co.) | MS-7 |
| | MS-75 |
| | HS-5 |
| | EH-5 |
| Wacker HDK | N 20 |
| (WACKER-CHEMIE GMBH) | V 15 |
| | N 20E |
| | T 30 |
| | T 40 |
| D-C Fine Silica | |
| (Dow Corning Co.) | |
| Fransol | |
| (Fransil Co.) | |

On the other hand, in order to produce silica powder to be used in the present invention through the wet process, various processes known heretofore may be applied. For example, decomposition of sodium silicate with an acid represented by the following scheme may be applied:

$$Na_2O.xSiO_2+HCl+H_2O \rightarrow SiO_2.nH_2O+NaCl.$$

In addition, there may also be used a process wherein sodium silicate is decomposed with an ammonium salt or an alkali salt, a process wherein an alkaline earth metal silicate is produced from sodium silicate and decomposed with an acid to form silicic acid, a process wherein a sodium silicate solution is treated with an ion-exchange resin to form silicic acid, and a process wherein natural silicic acid or silicate is utilized.

The silica power to be used herein may be anhydrous silicon dioxide (silica), and also a silicate such as aluminum silicate, sodium silicate, potassium silicate, magnesium silicate and zinc silicate.

Commercially available fine silica powders formed by the wet process include those sold under the trade names as shown below:

Carplex (available from Shionogi Seiyaku K.K.)
Nipsil ( Nippon Silica K.K.)
Tokusil, Finesil (Tokuyama Soda K.K.)
Bitasil (Tagi Seihi K.K.)
Silton, Silnex (Mizusawa Kagaku K.K.)
Starsil (Kamishima Kagaku K.K.)
Himesil (Ehime Yakuhin K.K.)
Siloid (Fuki Devison Kagaku K.K.)
Hi-Sil (Pittsuburgh Plate Glass Co.)
Durosil, Ultrasil (Fulstoff-Gesellshaft Marquart)
Manosil (Hardman and Holden)
Hoesch (Chemische Fabrik Hoesch K-G)
Sil-Stone (Stoner Rubber Co.)
Nalco (Nalco Chem. Co.)
Imsil (Illinois Minerals Co.)
Calcium Silikat (Chemische Fabrik Hoesch, K-G)
Calsil (Fullstoff-Gesellschaft Marquart)
Fortafil (Imperial Chemical Industries)
Microcal (Joseph Crosfield & Sons. Ltd.)
Manosil (Hardman and Holden)
Vulkasil (Farbenfabriken Bayer, A.G.)
Tufknit (Durham Chemicals, Ltd.)
Silmos (Shiraishi Kogyo K.K.)
Starlex (Kamishima Kagaku K.K.)
Furikosil (Tagi Seihi K.K.)

Among the above-mentioned silica powders, those having a specific surface area as measured by the BET method with nitrogen adsorption of 30 $m^2/g$ or more, particularly 50–400 $m^2/g$, provides a good result.

In the present invention, the silica fine powder may preferably be used in an amount of 0.01–8 wt. parts, more preferably 0.1–5 wt. parts, with respect to 100 wt. parts of the magnetic toner.

In case where the magnetic toner of the present invention is used as a positively chargeable magnetic toner, it is preferred to use positively chargeable fine silica powder rather than negatively chargeable fine silica powder, in order to prevent the abrasion of the toner particle and the contamination on the sleeve surface, and to retain the stability in chargeability.

In order to obtain positively chargeable silica fine powder, the above-mentioned silica powder obtained through the dry or wet process may be treated with a silicone oil having an organic groups containing at least one nitrogen atom in its side chain, a nitrogen-containing silane coupling agent, or both of these.

In the present invention, "positively chargeable silica" means one having a positive triboelectric charge with respect to iron powder carrier when measured by the blow-off method.

The silicone oil having a nitrogen atom in its side chain to be used in the treatment of silica fine powder may be a silicone oil having at least the following partial structure:

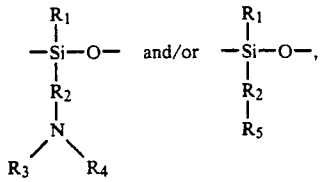

wherein $R_1$ denotes hydrogen, alkyl, aryl or alkoxyl; $R_2$ denotes alkylene or phenylene; $R_3$ and $R_4$ denotes hydrogen, alkyl, or aryl; and $R_5$ denotes a nitrogen-containing heterocyclic group. The above alkyl, aryl, alkylene and phenylene group can contain an organic group having a nitrogen atom, or have a substituent such as halogen within an extent not impairing the chargeability. The above-mentioned silicone oil may preferably be used in an amount of 1–50 wt. %, more preferably 5–30 wt. %, based on the weight of the silica fine powder.

The nitrogen-containing silane coupling agent used in the present invention generally has a structure represented by the following formula:

$$R_mSiY_n,$$

wherein R is an alkoxy group or a halogen atom; Y is an amino group or an organic group having at least one amino group or nitrogen atom; and m and n are positive integers of 1–3 satisfying the relationship of $m+n=4$.

The organic group having at least one nitrogen group may for example be an amino group having an organic group as a substituent, a nitrogen-containing heterocyclic group, or a group having a nitrogen-containing heterocyclic group. The nitrogen-containing heterocyclic group may be unsaturated or saturated and may respectively be known ones. Examples of the unsaturated heterocyclic ring structure providing the nitrogen-containing heterocyclic group may include the following:

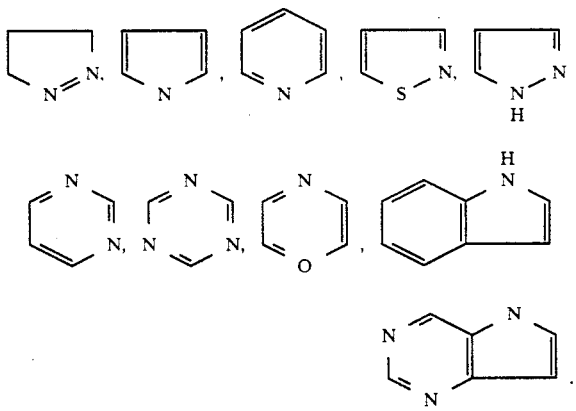

Examples of the saturated heterocyclic ring structure include the following:

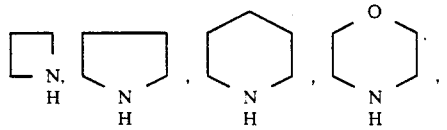

-continued

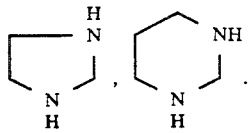

The heterocyclic groups used in the present invention may preferably be those of five-membered or six-membered rings in consideration of stability.

Examples of the silane coupling agent include:
aminopropyltrimethoxysilane,
aminopropyltriethoxysilane,
dimethylaminopropyltrimethoxysilane,
diethylaminopropyltrimethoxysilane,
dipropylaminopropyltrtimethoxysilane,
dibutylaminopropyltrimethoxysilane,
monobutylaminopropyltrimethoxysilane,
dioctylaminopropyltrimethoxysilane,
dibutylaminopropyldimethoxysilane,
dibutylaminopropylmonomethoxysilane,
dimethylaminophenyltriethoxysilane,
trimethoxysilyl-r-propylphenylamine, and
trimethoxysilyl-r-propylbenzyl-amine.

Further, examples of the nitrogen-containing heterocyclic compounds represented by the above structural formulas include:
trimethoxysilyl-r-propylpiperidine,
trimethoxysilyl-r-propylmorpholine, and
trimethoxysilyl-r-propylimidazole.

The above-mentioned nitrogen-containing silane coupling agent may preferably be used in an amount of 1–50 wt. %, more preferably 5–30 wt. %, based on the weight of the silica fine powder.

The thus treated positively chargeable silica powder shows an effect when added in an amount of 0.01–8 wt. parts and more preferably may be used in an amount of 0.1–5 wt. parts, respectively with respect to the positively chargeable magnetic toner to show a positive chargeability with excellent stability. As a preferred mode of addition, the treated silica powder in an amount of 0.1–3 wt. parts with respect to 100 wt. parts of the positively chargeable magnetic toner should preferably be in the form of being attached to the surface of the toner particles. The above-mentioned untreated silica fine powder may be used in the same amount as mentioned above.

The silica fine powder used in the present invention may be treated as desired with another silane coupling agent or with an organic silicon compound for the purpose of enhancing hydrophobicity. The silica powder may be treated with such agents in a known manner so that they react with or are physically adsorbed by the silica powder. Examples of such treating agents include hexamethyldisilazane, trimethylsilane, trimethylchlorosilane, trimethyl ethoxysilane, dimethyldichlorosilane, methyltrichloro silane, allyldimethylchlorosilane, allylphenyldichlorosilane, benzyldimethylcholrosilane, bromomethyldimethylchlorosilane, $\alpha$-chloroethyltrichlorosilane, $\beta$-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and containing each one hydroxyl group bonded to Si at the terminal units. These may be used alone or as a mixture of two or more compounds. The above mentioned treating agent may preferably be used in an amount of 1–40 wt. % based on the weight of the silica fine powder. However, the above treating agent may be used so that the final product of the treated silica fine powder shows positive chargeability.

In the present invention, it is preferred to add fine powder of a fluorine-containing polymer such as polytetra-fluoroethylene, polyvinylidene fluoride, or tetrafluoroethylene-vinylidene fluoride copolymer. Among these, polyvinylidene fluoride fine powder is particularly preferred in view of fluidity and abrasiveness. Such powder of a fluorine-containing polymer may preferably be added to the toner in an amount of 0.01–2.0 wt.%, particularly 0.02–1.0 wt.%.

In a magnetic toner wherein the silica fine powder and the above-mentioned fluorine-containing fine powder are combined, while the reason is not necessarily clear, there occurs a phemomenon such that the state of the presence of the silica attached to the toner particle is stabilized and, for example, the attached silica is prevented from separating from the toner particle so that the effect thereof on toner abrasion and sleeve contamination is prevented from decreasing, and the stability in chargeability can further be enhanced.

An additive may be mixed in the magnetic toner of the present invention as desired. More specifically, as a colorant, known dyes or pigments may be used generally in an amount of 0.5–20 wt. parts per 100 wt. parts of a binder resin. Another optional additive may be added to the toner so that the toner will exhibit further better performances. Optional additives to be used include, for example, lubricants such as zinc stearate; abrasives such as cerium oxide and silicon carbide; flowability improvers such as colloidal silica and aluminum oxide; anticaking agent; or conductivity-imparting agents such as carbon black and tin oxide.

In order to improve releasability in hot-roller fixing, it is also a preferred embodiment of the present invention to add to the magnetic toner a waxy material such as low-molecular weight polyethylene, low-molecular weight polypropylene, microcrystalline wax, carnauba wax, sasol wax or paraffin wax preferably in an amount of 0.5–5 wt. %.

The magnetic toner of the present invention contains a magnetic material which may also function as a colorant. The magnetic material to be contained in the magnetic toner may be one or a mixture of: iron oxides such as magnetite, hematite, ferrite and ferrite containing excess iron; metals such as iron, cobalt and nickel, alloys of these metals with metals such as aluminum, cobalt, copper, lead, magnesium, tin, zinc, antimony, beryllium, bismuth, cadmium, calcium, manganese, selenium, titanium, tungsten and vanadium.

These ferromagnetic materials may preferably be in the form of particles having an average particle size of the order of 0.1–1 micron, preferably 0.1–0.5 microns and be used in the toner in an amount of about 60–110 wt. parts, particularly 65–100 wt. parts, per 100 wt. parts of a resin component (or per 100 wt. parts of a binder resin in a case where the magnetic toner does not contain a resin other than the binder resin).

The magnetic toner for developing electrostatic images according to the present invention may be produced by sufficiently mixing magnetic powder with a vinyl or non-vinyl thermoplastic resin such as those enumerated hereinbefore, and optionally, a pigment or dye as colorant, a charge controller, another additive, etc., by means of a mixer such as a ball mill, etc.; then melting and kneading the mixture by hot kneading means such as hot rollers, kneader and extruder to disperse or dissolve the pigment or dye, and optional additives, if any, in the melted resin; cooling and crushing the mixture; and subjecting the powder product to precise classification to form magnetic toner according to the present invention.

The magnetic toner according to the present invention may preferably be applied to an image forming apparatus for practicing an image forming method wherein a latent image is developed while toner particles are caused to fly from a toner-carrying member such as a cylindrical sleeve to a latent image carrying member such as a photosensitive member.

The magnetic toner is supplied with triboelectric charge mainly due to the contact thereof with the sleeve surface and applied onto the sleeve surface in a thin layer form. The thin layer of the magnetic toner is formed so that the thickness thereof is smaller than the clearance between the photosensitive member and the sleeve in a developing region. In the development of a latent image formed on the photosensitive member, it is preferred to cause the magnetic toner particles having triboelectric charge to fly from the sleeve to the photosensitive member, while applying an alternating electric field between the photosensitive member and the sleeve.

Examples of the alternating electric field may include a pulse electric field, or an electric field based on an AC bias or a superposition of AC and DC biases.

Incidentally, in the present invention, the thin-line reproducibility may be measured in the following manner.

An original image comprising thin lines accurately having a width of 100 microns is copied under a suitable copying condition, i.e., a condition such that a circular original image having a diameter of 5 mm and an image density of 0.3 (halftone) is copied to provide a copy image having an image density of 0.3–0.5, thereby to obtain a copy image as a sample for measurement. An enlarged monitor image of the sample is formed by means of a particle analyzer (Luzex 450, mfd. by Nihon Regulator Co. Ltd.) as a measurement device, and the line width is measured by means of an indicator. Because the thin line image comprising toner particles has unevenness in the width direction, the measurement points for the line width are determined so that they correspond to the average line width, i.e., the average of the maximum and minimum line widths. Based on such measurement, the value (%) of the thin-line reproducibility is calculated according to the following formula:

$$\frac{\text{Line width of copy image obtained by the measurement}}{\text{Line width of the original (100 microns)}} \times 100$$

Further, in the present invention, the resolution may be measured in the following manner.

There is formed ten species of original images comprising a pattern of five thin lines which have equal line width and are disposed at equal intervals equal to the line width. In these ten species of original images, thin lines are respectively drawn so that they provide densities of 2.8, 3.2, 3.6, 4.0, 4.5, 5.0, 5.6, 6.3, 7.1, and 8.0 lines per 1 mm. These ten species of original images are copied under the above mentioned suitable copying conditions to form copy images which are then observed by means of a magnifying glass. The value of the resolution is so determined that it corresponds to the maximum number of thin lines (lines/mm) of an image wherein all the thin lines are clearly separated from each other. As the above mentioned number is larger, it indicates a higher resolution.

Hereinbelow, the present invention will be described in further detail with reference to Examples, by which the present invention is not limited at all. In the following formulations, "parts" are parts by weight.

Example 1

Styrene/butyl acrylate/divinyl benzene copolymer (copolymerization wt. ratio:

| | |
|---|---|
| 80/19.5/0.5, weight-average molecular weight: 320,000) | 100 wt. parts |
| Tri-iron tetraoxide (average particle size = 0.2 micron) | 80 wt. parts |
| Nigrosin (number-average particle size = about 3 microns) | 4 wt. parts |
| Low-molecular weight propylene-ethylene copolymer | 4 wt. parts |

The above ingredients were well blended in a blender and melt-kneaded at 150° C. by means of a two-axis extruder. The kneaded product was cooled, coarsely crushed by a cutter mill, finely pulverized by means of a pulverizer using jet air stream, and classified by a fixed-wall type wind-force classifier (DS-type Wind-Force Classifier, mfd. by Nippon Pneumatic Mfd. Co. Ltd.) to obtain a classified powder product. Ultra-fine powder and coarse power were simultaneously and precisely removed from the classified powder by means of a multi-division classifier utilizing a Coanda effect (Elbow Jet Classifier available from Nittetsu Kogyo K.K.), thereby to obtain black fine powder (magnetic toner) having a number-average particle size of 7.4 microns. When thus obtained black fine powder was mixed with iron powder carrier and thereafter the triboelectric charge thereof was measured, it showed a value of +8 μC/g.

Figure 5A:
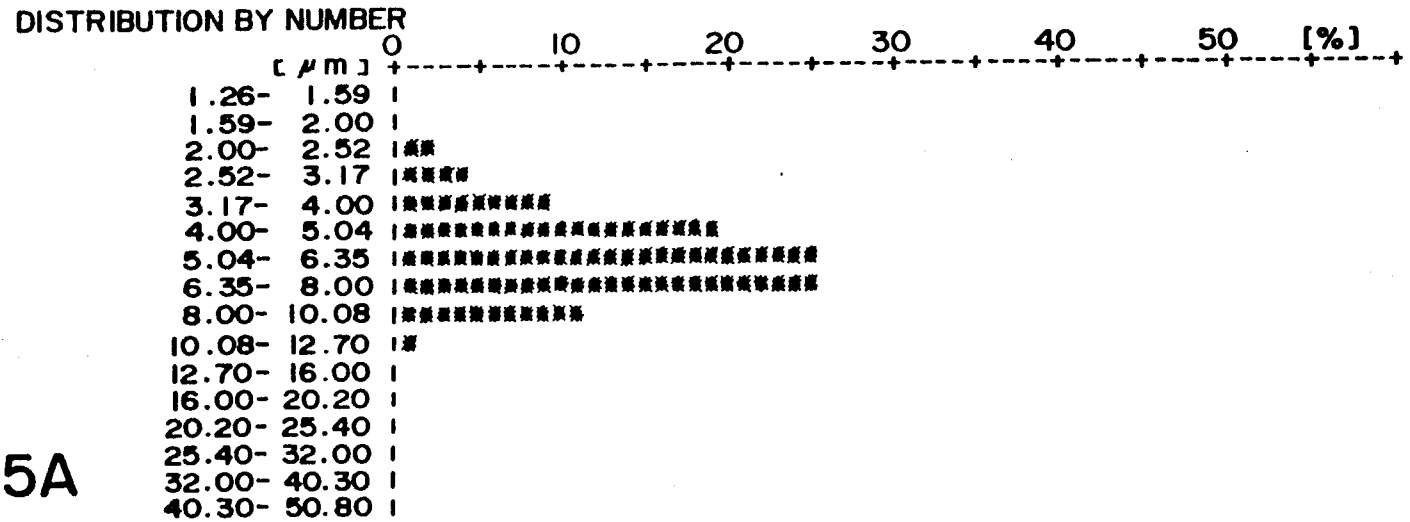
FIGS. 5A and 5B are graphs showing the particle size distribution in the magnetic toner of Example 1.
Figure 5B:
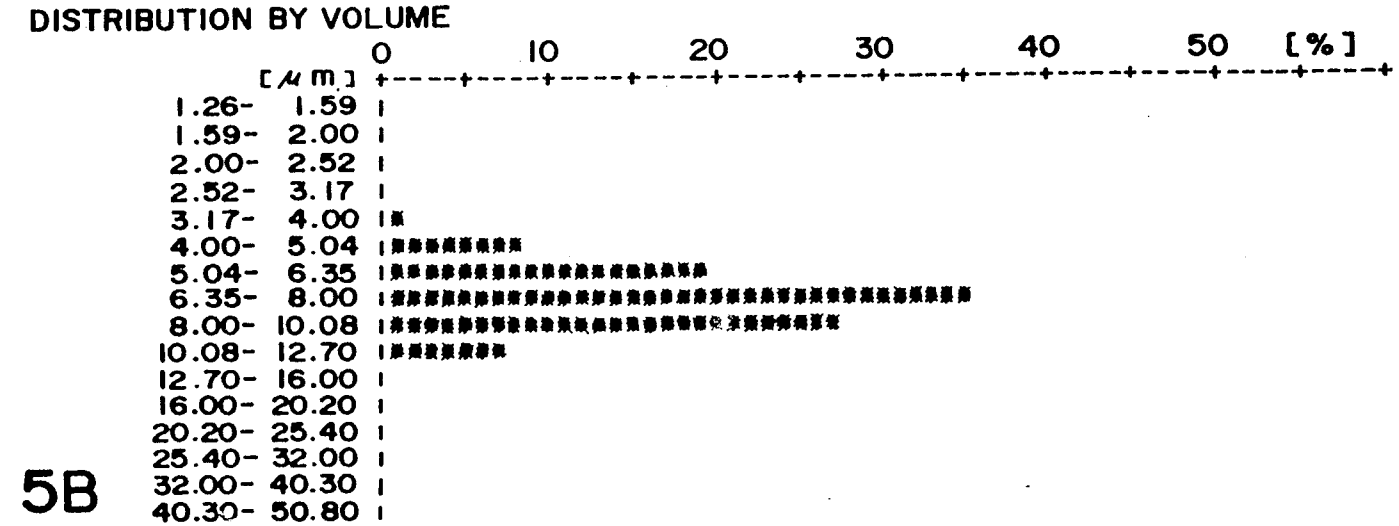

The number-basis distribution and volume-basis distribution of the thus obtained magnetic toner of positively chargeable black fine powder were measured by means of a Coulter counter Model TA-II with a 100 micron-aperture in the above-described manner. The thus obtained results are shown in the following Table 1 and FIGS. 5A and 5B.

TABLE 1

| Size (μm) | Number of particles | % by number (N) Distribution | % by number (N) Accumulation | % by volume (V) Distribution | % by volume (V) Accumulation |
|---|---|---|---|---|---|
| 2.00–2.52 | 2374 | 2.3 | 2.3 | 0.0 | 0.0 |
| 2.52–3.17 | 4351 | 4.2 | 6.6 | 0.4 | 0.4 |
| 3.17–4.00 | 9556 | 9.3 | 15.9 | 1.9 | 2.3 |
| 4.00–5.04 | 20048 | 19.5 | 35.4 | 8.1 | 10.3 |

TABLE 1-continued

| Size (μm) | Number of particles | % by number (N) Distribution | % by number (N) Accumulation | % by volume (V) Distribution | % by volume (V) Accumulation |
|---|---|---|---|---|---|
| 5.04–6.35 | 26486 | 25.8 | 61.3 | 19.7 | 30.0 |
| 6.35–8.00 | 25653 | 25.0 | 86.3 | 35.1 | 65.1 |
| 8.00–10.08 | 12200 | 11.9 | 98.2 | 27.2 | 92.3 |
| 10.08–12.70 | 1815 | 1.8 | 99.9 | 7.2 | 99.5 |
| 12.70–16.00 | 66 | 0.1 | 100.0 | 0.5 | 100.0 |
| 16.00–20.20 | 5 | 0.0 | 100.0 | 0.0 | 100.0 |
| 20.20–25.40 | 0 | 0.0 | 100.0 | 0.0 | 100.0 |
| 25.40–32.00 | 0 | 0.0 | 100.0 | 0.0 | 100.0 |
| 32.00–40.30 | 0 | 0.0 | 100.0 | 0.0 | 100.0 |
| 40.30–50.80 | 0 | 0.0 | 100.0 | 0.0 | 100.0 |

Figure 2:
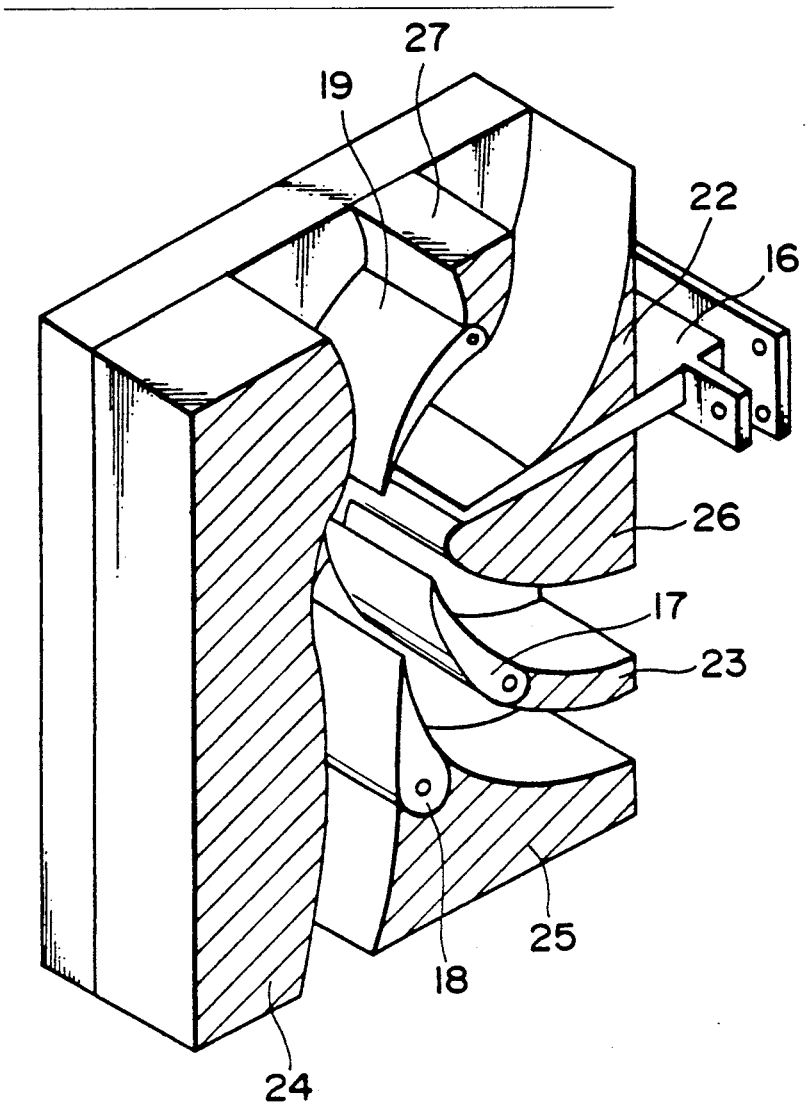

FIG. 1 schematically shows the classification step using the multi-division classifier, and FIG. 2 shows a sectional perspective view of the multi-division classifier.

0.5 wt. part of positively chargeable hydrophobic dry process silica (BET specific surface area: 200 $m^2/g$) was added to 100 wt. parts of the magnetic toner of black fine powder obtained above and mixed therewith by means of a Henschel mixer thereby to obtain a positively chargeable one-component developer comprising a magnetic toner.

The above-mentioned magnetic toner showed a particle size distribution and various characteristics as shown in Table 3 appearing hereinafter.

Figure 3:
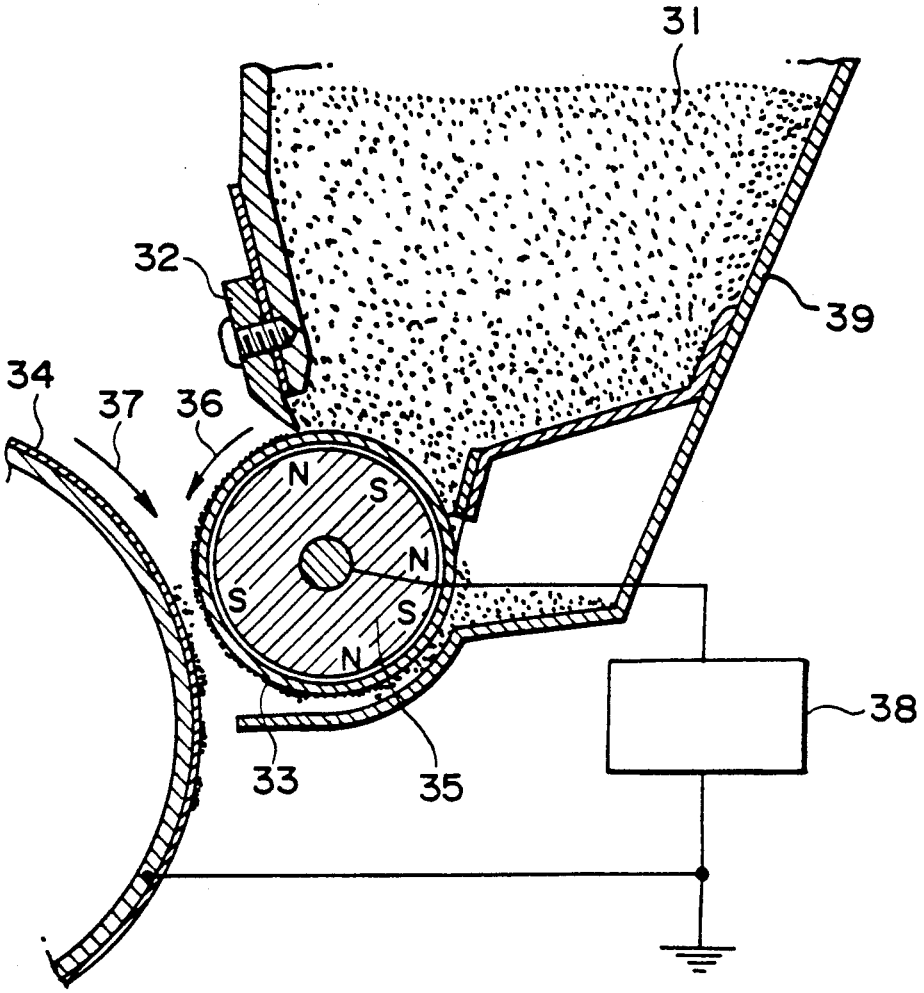
FIG. 3 is a schematic sectional view showing a developing device used for image formation in Examples and Comparative Examples.

The thus prepared one-component developer was charged in an image forming (developing) device as shown in FIG. 3, and a developing test was conducted. The developing conditions used in this instance is explained with reference to FIG. 3. In FIG. 3, the one-component developer 31 contained in a developer chamber 39 is applied in a thin layer form onto the surface of a cylindrical sleeve 33 of stainless steel as a toner-carrying means rotating in the direction of an arrow 36 by the medium of a magnetic blade 32 as a means for forming the layer of the toner. The clearance between the sleeve 33 and the blade 32 is set to about 250 microns. The sleeve 33 contains a fixed magnet 35 as a magnet means. The fixed magnet 35 produces a magnetic field of 1000 gauss in the neighborhood of the sleeve surface in the developing region where the sleeve 33 is disposed near to a photosensitive drum 34, as an electrostatic image holding means, comprising an organic photoconductor layer carrying a negative latent image. The minimum space between the sleeve 33 and the photosensitive drum 34 rotating in the direction of an arrow 37 is set to about 300 microns by means of a spacer roller (not shown) as a means for maintaining the space. The spacer roller has a disk-like shape having a diameter larger than that of the sleeve 33, and a thickness of about 5 mm–1 cm. Two spacer rollers are generally disposed at the both ends of the cylindrical sleeve 33, so that the center thereof corresponds to the rotation axis of the sleeve 33 and they contact the photosensitive drum 34. The spacer roller may be disposed so as to be rotatable or not.

In the development, a bias of 2000 Hz/1350 Vpp obtained by superposing an AC bias and a DC bias was applied between the photosensitive drum 34 and the sleeve by an alternating electric field-applying means 38. The layer of the one-component developer formed on the sleeve 33 had a thickness of about 75–150 microns, and the magnetic toner formed ears having a height of about 95 microns under the magnetic field to the fixed magnet 35.

By using the above-mentioned device, a negative latent image formed on the photosensitive drum 34 was developed by causing the one-component developer 31 having positive triboelectric charge to fly to the latent image. Thereafter, the resultant toner image was transferred to plain paper by using a negative corona transfer means and then fixed thereto by a hot pressure roller fixing means. Such image formation tests were successively conducted 10,000 times thereby to provide 10,000 sheets of toner images. The thus obtained results are shown in Table 4 appearing hereinafter.

As apparent from Table 4, both of the line portion and large image area portion of the letters showed a high image density. The magnetic toner of the present invention was excellent in thin-line reproducibility and resolution, and retained good image quality in the initial stage even after 10,000 sheets of image formations. Further, the copying cost per one sheet was low, whereby the magnetic toner of the present invention was excellent in economical characteristics.

Hereinbelow, the multi-division classifier and the classification step used in this instance are explained with reference to FIGS. 1 and 2.

Referring to FIGS. 1 and 2, the multi-division classifier has side walls 22, 23 and 24, and a lower wall 25. The side wall 23 and the lower wall 25 are provided with knife edge-shaped classifying wedges 17 and 18, respectively, whereby the classifying chamber is divided into three sections. At a lower portion of the side wall 22, a feed supply nozzle 16 opening into the classifying chamber is provided. A Coanda black 26 is disposed along the lower tangential line of the nozzle 16 so as to form a long elliptic arc shaped by bending the tangential line downwardly. The classifying chamber has an upper wall 27 provided with a knife edge-shaped gas-intake wedge 19 extending downwardly. Above the classifying chamber, gas-intake pipes 14 and 15 opening into the classifying chamber 15 are provided. In the intake pipes 14 and 15, a first gas introduction control means 20 and a second gas introduction control means 21, respectively, comprising, e.g., a damper, are provided; and also static pressure gauges 28 and 29 are disposed 20 communicatively with the pipes 14 and 15, respectively. At the bottom of the classifying chamber, exhaust pipes 11, 12 and 13 having outlets are disposed corresponding to the respective classifying sections and opening into the chamber.

Feed powder to be classified is introduced into the classifying zone through the supply nozzle 16 under reduced pressure. The feed powder thus supplied are caused to fall along curved lines 30 due to the Coanda effect given by the Coanda block 26 and the action of the streams of high-speed air, so that the feed powder is classified into coarse powder 11, black fine powder 12 having prescribed volume-average particle size and particle size distribution, and ultra-fine powder 13.

Example 2

A magnetic toner was prepared in the same manner as in Example 1 except that the amount of magnetic powder to be added thereto was changed and micropulverization and classification conditions were controlled to obtain a toner having characteristics as shown in Table 3 appearing hereinafter. The thus obtained toner was evaluated in the same manner as in Example 1.

As a result, as shown in Table 4 appearing hereinafter, clear high-quality images were stably obtained.

Example 3

A magnetic toner was prepared in the same manner as in Example 1 except that the amount of magnetic powder to be added thereto was changed and micropulverization and classification conditions were controlled to obtain a toner having characteristics as shown in Table 3 appearing hereinafter. The thus obtained toner was evaluated in the same manner as in Example 1.

As a result, as shown in Table 4 appearing hereinafter, clear high-quality images were stably obtained.

Example 4

0.5 wt. part of positively chargeable hydrophobic dry process silica and 0.3 wt. part of polyvinylidene fluoride fine powder (average primary particle size: about 0.3 micron, weight-average molecular weight (Mw): 300,000) were added to 100 wt. parts of the black fine powder obtained in Example 1, and mixed therewith by means of a Henschel mixer thereby to obtain a one-component developer.

The thus obtained developer was evaluated in the same manner as in Example 1. As a result, as shown in Table 4 appearing hereinafter, the were obtained better images excellent in image density and image quality.

Example 5

| | |
|---|---|
| Crosslinked polyester resin (Mw = 50,000, glass transition point Tg = 60° C.) | 100 wt. parts |
| 3,5-di-t-butylsalicylic acid metal salt | 1 wt. part |
| Tri-iron tetroxide (average particle size = 0.2 micron) | 70 wt. parts |
| Low-molecular weight propylene-ethylene copolymer | 3 wt. parts |

By using the above materials, black fine powder was prepared in the same manner as in Example 1.

0.3 wt. part of negatively chargeable hydrophobic silica (BET specific surface area: 130 $m^2/g$) was added to 100 wt. parts of the black fine powder (magnetic toner) obtained above and mixed therewith by means of a Henschel mixer thereby to obtain a negatively chargeable one-component developer.

The above-mentioned black fine powder showed a particle size distribution, etc., as shown in Table 3 appearing hereinafter.

The thus prepared one-component developer was charged in a copying machine (NP-7550, mfd. by Canon K.K.) having an amorphous silicon photosensitive drum capable of forming a negative electrostatic latent image and image formation tests of 10,000 sheets were conducted.

As a result, as shown in Table 4 appearing hereinafter, clear high-quality images were stably obtained.

Example 6

The positively chargeable one-component developer prepared in Example 1 as charged in a digital-type copying machine (NP-9330, mfd. by Canon K.K.) having an amorphous silicon photosensitive drum and image formation tests of 10,000 sheets were conducted by developing a positive electrostatic latent image by a reversal development system.

As a result, as shown in Table 4 appearing 5 hereinafter, the thin-line reproducibility and resolution were excellent and there were obtained clear images having a high gradational characteristic.

Example 7

Black fine powder as shown in Table 3 was prepared in a similar manner as in Example 1.

0.6 wt. parts of positively chargeable hydrophobic silica was added to 100 wt. parts of the black fine powder obtained above and mixed therewith to obtain a positively chargeable one-component developer.

The thus prepared one-component developer was charged in a commercially available copying machine (NP-3525, mfd. by Canon K.K.) having a photosensitive drum comprising an organic photoconductor and image formation tests of 10,000 sheets were conducted.

The results are shown in Table 4 appearing hereinafter.

Comparative Example 1

Black fine powder (magnetic toner) as shown in Table 3 was prepared in the same manner as in Example 1, except that two fixed-wall type wind-force classifiers used in Example 1 were used for the classification instead of the combination of the fixed-wall type wind-force classifier and the multi-division classifier used in Example 1.

Figure 6A:
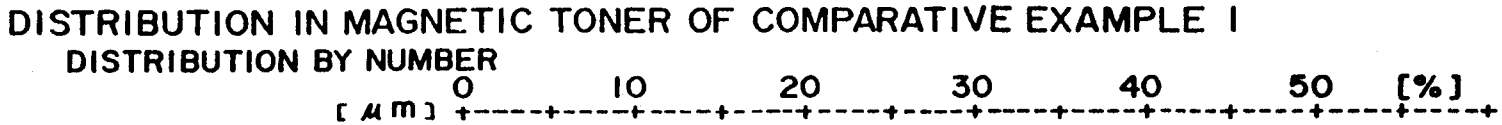
FIGS. 6A and 6B are graphs showing the particle size distribution in the magnetic toner of Comparative Example 1.
Figure 6B:
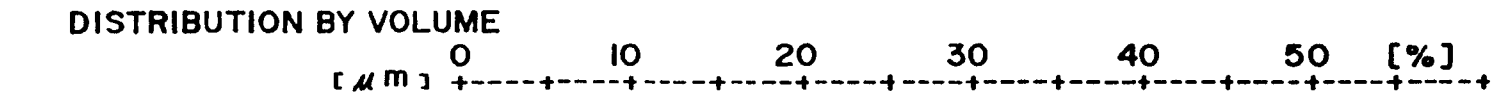

In the thus prepared magnetic toner of Comparative Example 1, percentage by number of the magnetic toner particles of 5 microns or smaller was smaller than the range thereof defined in the present invention, the volume-average particle size was larger than the range thereof defined in the present invention, and the value of (% by number (N))/(% by volume (V)) is larger than the range thereof defined in the present invention, whereby the conditions required in the present invention were not satisfied. The particle size distribution of magnetic toner obtained above is shown in the following Table 2 and FIGS. 6A and 6B.

TABLE 2

| Size (μm) | Number of particles | % by number (N) Distribution | % by number (N) Accumulation | % by volume (V) Distribution | % by volume (V) Accumulation |
|---|---|---|---|---|---|
| 2.00–2.52 | 992 | 1.4 | 1.4 | 0.0 | 0.0 |
| 2.52–3.17 | 1035 | 1.4 | 2.8 | 0.0 | 0.0 |
| 3.17–4.00 | 1210 | 1.7 | 4.5 | 0.0 | 0.0 |
| 4.00–5.04 | 3093 | 4.3 | 8.8 | 0.6 | 0.6 |
| 5.04–6.35 | 3189 | 11.4 | 20.3 | 3.2 | 3.8 |

TABLE 2-continued

| Size (μm) | Number of particles | % by number (N) Distribution | % by number (N) Accumulation | % by volume (V) Distribution | % by volume (V) Accumulation |
|---|---|---|---|---|---|
| 6.35–8.00 | 15353 | 21.4 | 41.7 | 10.8 | 14.7 |
| 8.00–10.08 | 19040 | 26.6 | 68.3 | 21.5 | 36.1 |
| 10.08–12.70 | 15920 | 22.2 | 90.5 | 33.7 | 69.9 |
| 12.70–16.00 | 6161 | 8.6 | 99.1 | 25.8 | 95.7 |
| 16.00–20.20 | 584 | 0.8 | 100.0 | 4.3 | 100.0 |
| 20.20–25.40 | 25 | 0 | 100.0 | 0.0 | 100.0 |
| 25.40–32.00 | 1 | 0 | 100.0 | 0.0 | 100.0 |
| 32.00–40.30 | 0 | 0 | 100.0 | 0.0 | 100.0 |
| 40.30–50.80 | 0 | 0 | 100.0 | 0.0 | 100.0 |

0.5 wt. parts of positively chargeable hydrophobic dry process silica was added to 100 wt. parts of the magnetic toner of black fine powder obtained above mixed therewith in the same manner as in Example 1 thereby to obtain a one-component developer. The thus obtained developer was subjected to image formation tests under the same conditions as in Example 1.

Referring to FIG. 3, the height of ears formed in the developing region of the sleeve 33 was about 165 microns which was longer than that in Example 1. In the resultant images, the toner particles remarkably protruded from the latent image formed on the photosensitive member, the thin-line reproducibility was 135 % which was poorer than that in Example 4, and the resolution was 4.5 lines/mm. Further, after 1000 sheets of image formations, the image density in the solid black pattern decreased and the thin line reproducibility and resolution deteriorated. Moreover, the toner consumption was large.

The results are shown in Table 4 appearing hereinafter.

Comparative Example 2

Evaluation was conducted in the same manner as in Example 1 except that a toner as shown in Table 3 was used instead of the magnetic toner used in Example 1.

In the resultant images, thin lines were contaminated in several places presumably due to the aggregates of toner particles, and the resolution was 4.5 line/mm. The solid black pattern, particularly the inner portion thereof, had a lower image density than that in the line image and the edge portion of the image. Further, fog contamination in spot forms occurred, and the image quality was further deteriorated in successive copying.

Comparative Example 3

Evaluation was conducted in the same manner as in Example 1 except that a toner as shown in Table 3 was used instead of the magnetic toner used in Example 1.

The developed image formed on the drum had relatively good image quality, while it was somewhat disturbed. However, the toner image was remarkably disturbed in the transfer step, whereby transfer failure occurred and the image density decreased. Particularly, in successive copying, the image density was further decreased and the image quality was further deteriorated because poor toner particles remained and accumulated in the developing device.

Comparative Example 4

Evaluation was conducted in the same manner as in Example 1 except that a toner as shown in Table 3 was used instead of the magnetic toner used in Example 1.

In the resultant images, the image density was low and the contour was unclear and the sharpness was lacking, because the cover-up of toner particles to the edge portions of images was poor. Further, the resolution and gradational characteristic were also poor. When successive copying was conducted, the sharpness, thin-line reproducibility and resolution were further deteriorated.

Comparative Example 5

Evaluation was conducted in the same manner as in Example 1 except that a toner as shown in Table 3 was used instead of the magnetic toner used in Example 1.

In the resultant images, the image density, resolution and the thin line reproducibility were all poor. When the ears of toner particles formed on the sleeve as the toner-carrying member of the developing device were observed, they were long and sparse. As a result, when the toner particles were caused to fly to the photosensitive member, because the ears were too long, the toner particles protruded from the latent image whereby trailing and scattering of the toner occurred. Further, the image density was low because of coarse cover-up of the toner particles.

The results in Examples 1–7 and Comparative Examples 1–5 described above are inclusively shown in the following Tables 3 and 4.

TABLE 3

| | Particle size distribution of tonor | | | | |
|---|---|---|---|---|---|
| | % by number of particles ≦5 μm | % by volume of particles ≧16 μm | % by number of particles of 8–12.7 μm | Volume-average particle size (μm) | (% by number)/(% by volume) of particles ≦5 μm |
| Example | | | | | |
| 1 | 35 | 0.0 | 14 | 7.4 | 3.4 |
| 2 | 46 | 0.3 | 11 | 6.5 | 3.3 |
| 3 | 20 | 0.5 | 23 | 8.5 | 5.0 |
| 4 | 35 | 0.3 | 14 | 7.4 | 3.6 |
| 5 | 40 | 0.5 | 12 | 7.5 | 3.9 |
| 6 | 35 | 0.3 | 14 | 7.4 | 3.6 |
| 7 | 57 | 0.2 | 10 | 5.7 | 2.5 |
| Comparative | | | | | |

TABLE 3-continued

| Example | | | | | |
|---|---|---|---|---|---|
| 1 | 8.8 | 4.3 | 48.8 | 11.3 | 14.5 |
| 2 | 68 | 0.2 | 7 | 6.5 | 1.5 |
| 3 | 30 | 4 | 17 | 7.5 | 6.1 |
| 4 | 43 | 0.5 | 7 | 6.8 | 2.2 |
| 5 | 12 | 0.2 | 56 | 9.5 | 2.5 |

| | | Magnetic characteristics of toner | | |
|---|---|---|---|---|
| | True density of toner ($g/cm^3$) | Saturation magnetization $\sigma_s$ (emu/g) | Residual magnetization $\sigma_r$ (emu/g) | Coersive force Hc (Oe) |
| Example | | | | |
| 1 | 1.56 | 27 | 3.2 | 91 |
| 2 | 1.69 | 38 | 4.2 | 92 |
| 3 | 1.51 | 25 | 2.8 | 90 |
| 4 | 1.56 | 27 | 3.2 | 91 |
| 5 | 1.50 | 26 | 1.4 | 48 |
| 6 | 1.56 | 27 | 3.2 | 91 |
| 7 | 1.62 | 31 | 3.7 | 90 |
| Comparative Example | | | | |
| 1 | 1.43 | 22 | 2.3 | 90 |
| 2 | 1.69 | 36 | 4.4 | 91 |
| 3 | 1.47 | 25 | 1.5 | 65 |
| 4 | 1.77 | 43 | 5.0 | 107 |
| 5 | 1.43 | 24 | 1.4 | 49 |

TABLE 4

| | Initial stage | | | |
|---|---|---|---|---|
| | Dmax *1 (5 mm diameter) | Dmax *2 (solid black portion) | Thin-line reproducibility | Resolution (lines/mm) |
| Example | | | | |
| 1 | 1.32 | 1.32 | 105% | 6.3 |
| 2 | 1.34 | 1.32 | 102% | 6.3 |
| 3 | 1.31 | 1.30 | 108% | 5.6 |
| 4 | 1.38 | 1.38 | 105% | 6.3 |
| 5 | 1.34 | 1.33 | 105% | 6.3 |
| 6 | 1.38 | 1.38 | 100% | 7.1 |
| 7 | 1.34 | 1.30 | 109% | 5.6 |
| Comparative Example | | | | |
| 1 | 1.31 | 1.30 | 135% | 4.5 |
| 2 | 1.34 | 1.23 | 125% | 4.5 |
| 3 | 1.24 | 1.20 | 115% | 5.6 |
| 4 | 1.23 | 1.20 | 110% | 5.6 |
| 5 | 1.19 | 1.12 | 135% | 4.0 |

| | After 10,000 sheets of image formations | | | | |
|---|---|---|---|---|---|
| | Dmax (5 mm diameter) | Dmax (Solid black portion) | Thin-line reproducibility | Resolution (lines/mm) | Toner consumption (g/one sheet) |
| Example | | | | | |
| 1 | 1.36 | 1.35 | 104% | 6.3 | 0.032 |
| 2 | 1.37 | 1.37 | 102% | 6.3 | 0.030 |
| 3 | 1.33 | 1.32 | 110% | 5.6 | 0.033 |
| 4 | 1.40 | 1.39 | 100% | 6.3 | 0.036 |
| 5 | 1.34 | 1.33 | 105% | 6.3 | 0.035 |
| 6 | 1.40 | 1.40 | 100% | 7.1 | 0.035 |
| 7 | 1.34 | 1.29 | 115% | 5.6 | 0.030 |
| Comparative Example | | | | | |
| 1 | 1.31 | 1.25 | 150% | 4.0 | 0.055 |
| 2 | 1.33 | 1.19 | 140% | 4.0 | 0.040 |
| 3 | 1.20 | 1.03 | 135% | 4.0 | 0.039 |
| 4 | 1.21 | 1.10 | 125% | 4.0 | 0.041 |
| 5 | 1.15 | 1.04 | 140% | 4.0 | 0.053 |

*1 The image density of a copy image obtained by copying an original circular image which had a diameter of 5 mm and comprised a solid black pattern.
*2 The image density of a copy image obtained by copying an A-3 original image which comprised a solid black pattern.

Examples 8–10

Three species of magnetic toners respectively having characteristics as shown in the following Table 5 were prepared in the same manner as in Example 1, except that the amount of magnetic powder to be added thereto was changed and micropulverization and classification conditions were controlled to obtain a toner having characteristics as shown in Table 5.

TABLE 3

| Example | Particle size distribution of tonor | | | | |
|---|---|---|---|---|---|
| | % by number of particles ≦5 μm | % by volume of particles ≧16 μm | % by number of particles of 8–12.7 μm | volume-average particle size (μm) | (% by number)/(% by volume) of particles ≦5 μm |
| 8 | 18 | 0.2 | 20 | 7.7 | 5.6 |
| 9 | 58 | 0.5 | 9 | 5.1 | 4.0 |
| 10 | 19 | 0.0 | 17 | 8.5 | 3.9 |

Three species of one-component magnetic developers were prepared in the same manner as in Example 1 except that the above-mentioned magnetic toners of Examples 8–10 were respectively used. The thus prepared developers were respectively subjected to image formation tests in the same manner as in Example 1.

As a result, each developer showed good developing characteristics similarly as in Example 1. However, in the developer of Example 8, the thin-line reproducibility and resolution were somewhat inferior to those in Example 1. In the developer of Example 9, the stability in image quality in successive copying was somewhat inferior to that in Example 1. Further, in the developer of Example 10, the image density in the solid black portion was somewhat inferior to that in Example 1.

FIG. 4 shows a graph obtained by plotting values of % by number (N)/% by volume (V) against % by number with respect to magnetic toner particles having a particle size of 5 microns or below in Examples and Comparative Examples. In FIG. 4, the portion surrounded by solid lines denotes the range as defined by the present invention. The symbols "E-1" to "E-10" respectively denote the above-mentioned values obtained in Examples 1–10, and the symbols "C-1" to "C-5" respectively denote the above-mentioned values obtained in Comparative Examples 1–5.

As described hereinabove, the magnetic toners outside the range defined by the present invention were inferior to the magnetic toners according to the present invention with respect to the thin-line reproducibility resolution, image density in the solid black portion, fog and/or the toner consumption.

Example 11

A magnetic toner was prepared in the same manner as in Example 1 except that a small amount (55 wt. parts) of the magnetic material was used.

A one-component magnetic developer was prepared in the same manner as in Example 1 except that the above-prepared magnetic toner was used. The thus prepared developer was subjected to image formation tests in the same manner as in Example 1.

In the resultant image, a somewhat high degree of fog was observed as compared with that in Example 1, and the thin-line reproducibility was somewhat inferior to that in Example 1.

Example 12

A magnetic toner was prepared in the same manner as in Example 1 except that a larger amount (120 wt. parts) of the magnetic material was used.

A one-component magnetic developer was prepared in the same manner as in Example 1 except that the above-prepared magnetic toner was used. The thus prepared developer was subjected to image formation tests in the same manner as in Example 1.

In the resultant image, the image density in the solid black portion was somewhat low and the sharpness of the toner image was somewhat inferior as compared with those in Example 1.

What is claimed is:

1. An image forming device for developing electrostatic images held on an electrostatic image holding member, comprising:

a developer chamber containing a developer for developing the electrostatic images, comprising a magnetic toner comprising a binder resin and magnetic powder, said developer containing 17–60 % by number of magnetic toner particles having a particle size of 5 microns or smaller, containing 1–23 % by number of magnetic toner particles having a particle size of 8–12.7 microns, and containing 2.0 % by volume or less of magnetic toner particles having a particle size of 16 microns or larger; wherein the magnetic toner has a volume-average particle size of 4–9 microns, and the magnetic toner particles having a particle size of 5 microns or smaller has a particle size distribution satisfying the following formula:

$$N/V = -0.04.V + k,$$

wherein N denotes the percentage by number of magnetic toner particles having a particle size of 5 micron or smaller, V denotes the percentage by volume of magnetic toner particles having a particle size of 5 microns or smaller, k denotes a positive number of 4.5–6.5, and N denotes a positive number of 17–60;

toner-carrying means having a surface to hold a toner layer thereon and to carry the toner layer to a developing zone; the toner layer being formed of the magnetic toner particles supplied from the developer chamber, said toner-carrying means being made of a non-magnetic material;

magnetic means for generating a stationary magnetic field at the developing zone through the non-magnetic toner-carrying means toward the surface of the electrostatic image-holding member;

means for forming the layer of the magnetic toner particles of substantially uniform thickness on the surface of the toner-carrying means; and means for maintaining a space between the toner-carrying means and the electrostatic image-holding member at the developing zone within a predetermined range to form a space gap between the electostatic image-holding member and the surface of the layer of the magnetic toner particles on said toner-carrying means.

2. An image forming device according to claim 1, which further comprises means for applying an alternating electric field to the developing zone.

3. An image forming device according to claim 1, wherein the developer comprises a mixture of the magnetic toner and silica fine powder.

* * * * *

UNITED STATES PATENT AND TRADEMARK OFFICE

CERTIFICATE OF CORRECTION

PATENT NO. : 5,014,089

DATED : May 7, 1991

INVENTOR(S) : Kiichiro Sakashita, et al

It is certified that error appears in the above-identified patent and that said Letters Patent is hereby corrected as shown below:

Title Page:
IN [57] ABSTRACT

Line 14, "5 micron" should read --5 microns--.

COLUMN 1

Line 12, "developer a" should read --developer, a--.
Line 54, "more" should be deleted.
Line 64, "Pat. Nos. 3942979, 3969251 and 4112024)" should read --Pat. Nos. 3,942,979, 3,969,251 and 4,112,024)--.

COLUMN 2

Line 3, "uniform image." should read --uniform and dense cover-up of the toner particles to a latent image.--.
Line 19, "U.S. Pat. No. 4284701)" should read --U.S. Pat. No. 4,284,701)--.
Line 34, "U.S. Pat. No. 4299900" should read --U.S. Pat. No. 4,299,900--.
Line 60, "performances" should read --performance--.

COLUMN 3

Line 48, "volume average" should read --volume-average--.
Line 56, "5 micron" should read --5 microns--.
Line 60, "image forming" should be deleted.
Line 61, "device for developing electrostatic" should be deleted.

UNITED STATES PATENT AND TRADEMARK OFFICE

CERTIFICATE OF CORRECTION

PATENT NO. : 5,014,089

DATED : May 7, 1991

INVENTOR(S) : Kiichiro Sakashita, et al

It is certified that error appears in the above-identified patent and that said Letters Patent is hereby corrected as shown below:

COLUMN 4

Line 10, "has" should read --have--.
Line 15, "5 micron" should read --5 microns--.
Line 27, "non mag-" should read --non-mag- --.
Line 34, "image holding" should read --image-holding--.

COLUMN 5

Line 15, "one component" should read --one-component--.

COLUMN 7

Line 11, "hand, the" should read --hand, if the--.
Line 36, "5.5 Further," should read --5.5. Further,--.
Line 51, "distribution, the" should read --distribution, and the--.

COLUMN 8

Line 55, "Form" should read --From--.

COLUMN 9

Line 3, "hand, the" should read --hand, if the--.
Line 42, "214 4.5 emu/g;" should read --2-4.5 emu/g;--.
Line 54, "styrenevinylnaphthalene" should read --styrene-vinylnaphthalene--.
Line 63, "resin modified" should read --resin-modified--.

UNITED STATES PATENT AND TRADEMARK OFFICE

CERTIFICATE OF CORRECTION

PATENT NO. : 5,014,089

DATED : May 7, 1991

INVENTOR(S) : Kiichiro Sakashita, et al

It is certified that error appears in the above-identified patent and that said Letters Patent is hereby corrected as shown below:

COLUMN 11

Line 40, "acetyl-acetonate," should read --acetylacetonate,--.

COLUMN 12

Line 23, "vapor phase" should read --vapor-phase--.
Line 38, "vapor phase" should read --vapor-phase--.

COLUMN 13

Line 25, "(Pittsuburgh" should read --(Pittsburgh--.
Line 26, "(Fulstoff-Gesellshaft" should read --(Fullstoff-Gesellschaft--.
Line 30, "Nalco (Nalco Chem. Co.)" should read --Nalco (Nalco Chem. Co.) Quso (Philadelphia Quartz Co.)--.
Line 45, "provides" should read --provide--.
Line 60, "groups" should read --group--.

COLUMN 14

Line 13, "denotes" (second occurrence) should read --denote--.

UNITED STATES PATENT AND TRADEMARK OFFICE

CERTIFICATE OF CORRECTION

PATENT NO. : 5,014,089

DATED : May 7, 1991

INVENTOR(S) : Kiichiro Sakashita, et al

It is certified that error appears in the above-identified patent and that said Letters Patent is hereby corrected as shown below:

COLUMN 15

Line 16, "dipropylaminopropyltrtimethoxysilane" should read --dipropylaminopropyltrimethoxysilane--.
Line 23, "trimethoxysilyl-r-propylphenylamine" should read --trimethoxysilyl-α-propylphenylamine--.
Line 24, "trimethoxysilyl-r-propylbenzyl-amine" should read --trimethoxysilyl-α-propylbenzylamine--.
Line 28, "trimethoxysilyl-r-propylpiperidine" should read --trimethoxysilyl-α-propylpiperidine--.
Line 29, "trimethoxysilyl-r-propylmorpholine" should read --trimethoxysilyl-α-propylmorpholine--.
Line 30, "trimethoxysilyl-r-propylimidazole" should read --trimethoxysilyl-α-propylimidazole--.
Line 57, "methyltrichloro silane," should read --methyltrichlorosilane,--.

COLUMN 16

Line 3, "above mentioned" should read --above-mentioned--.
Line 20, "phemomenon" should read --phenomenon--.

COLUMN 18

Line 3, "is" should read --are--.
Line 10, "above mentioned" should read --above-mentioned--.
Line 16, "above mentioned" should read --above-mentioned--.

UNITED STATES PATENT AND TRADEMARK OFFICE

CERTIFICATE OF CORRECTION

PATENT NO. : 5,014,089

DATED : May 7, 1991

INVENTOR(S) : Kiichiro Sakashita, et al

It is certified that error appears in the above-identified patent and that said Letters Patent is hereby corrected as shown below:

COLUMN 19

Line 46, "image holding" should read --image-holding--.

COLUMN 20

Line 45, "black" should read --block--.

COLUMN 21

Line 37, "the" should read --there--.
Line 53, "0.3 wt. part" should read --0.3 wt. parts--.

COLUMN 22

Line 15, "as" should read --was--.
Line 21, "5" should be deleted.

COLUMN 23

Line 30, "thin line" should read --thin-line--.

COLUMN 24

Line 42, "thin line" should read --thin-line--.
TABLE 3, "tonor" should read --toner--.

COLUMN 26

TABLE 3-continued, "Coersive" should read --Coercive--.

UNITED STATES PATENT AND TRADEMARK OFFICE

CERTIFICATE OF CORRECTION

PATENT NO. : 5,014,089

DATED : May 7, 1991

INVENTOR(S) : Kiichiro Sakashita, et al

It is certified that error appears in the above-identified patent and that said Letters Patent is hereby corrected as shown below:

COLUMN 27

TABLE 3, "TABLE 3" should read --TABLE 5-- and "tonor" should read --toner--.

COLUMN 28

Line 16, "image holding" should read --image-holding--.
Line 31, "has" should read --have--.
Line 36, "5 micron" should read --5 microns--.

Signed and Sealed this

Eighth Day of December, 1992

*Attest:*

DOUGLAS B. COMER

*Attesting Officer*

*Acting Commissioner of Patents and Trademarks*